US011931620B2

(12) United States Patent
Powell

(10) Patent No.: US 11,931,620 B2
(45) Date of Patent: Mar. 19, 2024

(54) ADAPTER FOR J-HOOK / J-CUP

(71) Applicant: Mark William Powell, Spring, TX (US)

(72) Inventor: Mark William Powell, Spring, TX (US)

( * ) Notice: Subject to any disclaimer, the term of this patent is extended or adjusted under 35 U.S.C. 154(b) by 0 days.

(21) Appl. No.: 17/714,100

(22) Filed: Apr. 5, 2022

(65) Prior Publication Data

US 2023/0310919 A1 Oct. 5, 2023

(51) Int. Cl.
*A63B 21/078* (2006.01)
*A63B 23/04* (2006.01)

(52) U.S. Cl.
CPC ..... *A63B 21/078* (2013.01); *A63B 2023/0411* (2013.01)

(58) Field of Classification Search
CPC ..... A63B 21/078; A63B 2023/0411; A63B 21/0724; A63B 2225/09; A63B 21/0783; A63B 71/0036; A63B 2225/093; A63B 17/04; A63B 23/1218; A63B 21/169; A63B 2210/50; A63B 2210/00; A63B 21/4033; A63B 21/00047
See application file for complete search history.

(56) References Cited

FOREIGN PATENT DOCUMENTS

GB 2518437 A * 3/2015 ..... A47F 7/00

OTHER PUBLICATIONS

3DSolutionsTX, J-Cup/J-Hook Adapter-Adapts 3'j-cup to 2'rack, Etsy, pp. 1-4 (Year: 2021).*

* cited by examiner

*Primary Examiner* — Sundhara M Ganesan
*Assistant Examiner* — Jacqueline N L Loberiza

(57) ABSTRACT

A self-supporting apparatus of varying dimensions, which occupies the gap between the bracket of a j-hook channel and the adjoining squat rack upright. Spacer body is appropriately sized to encompass the excess space existing between the back channel of an oversized j-hook and the back side of the smaller squat rack upright, thereby providing a generalized means of adapting a larger bracket such that it may be coupled to a rack or rig of smaller size.

3 Claims, 15 Drawing Sheets

ADAPTER FOR J-HOOK / J-CUP

FIELD OF THE INVENTION

The present invention relates to the field of weightlifting equipment. More specifically, the present invention relates to weightlifting equipment utilized with racks and rigs in the form of a bracket assembly coupled to the rack or rig. Specifically, the present invention relates to a generalized means of adapting a larger bracket such that it may be coupled to a rack or rig of smaller size.

BACKGROUND OF THE INVENTION

In both professional and home gyms, weight-lifting exercises are typically accomplished using an exercise rack (or rig), colloquially known as a "power rack", "squat rack", "squat stand", or "squat cage", amongst others. Conventional exercise racks have been in use for years, generally consisting of two (2) to (6) vertical legs (or uprights), typically hollow steel tubes having rectangular cross-section and a plurality of vertically spaced holes extending horizontally through front and back. The uprights are connected laterally via additional horizontal members for increased stability. More recently, wall-mounted racks have appeared on the market (see U.S. Pat. No. 9,649,525 B2).

Exercise racks typically utilize uprights having a rectangular cross-section of 2"×2", 2"×3", 3"×2", or 3"×3". The smaller 2×2 cross-section is a typical size for home gym use, while the larger (and stronger) 2×3, 3×2, and 3×3 cross-sections are generally more suited to commercial and professional use.

In both traditional multi-leg and wall-mounted racks, the loaded barbell is supported by use of a j-hook (also called a j-cup), as described in US 2019/0247701 A1. Additionally, the pin-and-channel mechanism by which the j-hook is held in place has been adapted to a variety of rack accessories including dip bars, spotter bars, pull-up bars, and others.

The j-hook is mounted onto the rack by positioning the j-hook horizontally at approximately 90-degrees to a vertical upright of the rack, such that the channel is away from the line of contact with the vertical upright. From this position, the pin is extended through corresponding front and back holes in the upright. Once the pin has been inserted, the j-hook is rotated downward so as to direct the channel to seat around the side and rear of the upright, where it is held in this position by gravity. The weighted barbell may then be lowered into engagement with the upward-facing cradle of the j-hook, at which point the weight will be borne on the pin. The channel wraps around the side and back of the upright, fixing the j-hook in the lateral directions, and preventing it from sliding forward and out of engagement with the upright.

It is common for owners/users of exercise racks to install two or more complete sets of j-hooks at various heights to accommodate multiple exercises without having to physically relocate the j-hooks; e.g., one at a lower height suitable for bench press, with a second set at a higher height for squat exercises.

It is in this desire for a second set of j-hooks (or to replace an old or broken j-hook) that owners of 2×2 exercise racks have discovered a significant market disadvantage; i.e., it is difficult—bordering on impossible—to procure additional j-hooks for their 2×2 racks. Very few companies manufacture and sell j-hooks sized for 2×2 racks, and those that do typically fit only that company's own specific rack design. The resulting dilemma is that owners of 2×2 racks are unable to find commercially-produced j-hooks having a pin diameter that fits their home rack. Frustratingly for such owners, commercially-produced j-hooks in 2×3 and 3×3 are plentiful, and j-hooks in these over-sizes with suitable pin diameter are readily available.

Therefore, what is needed is a mechanism by which to adapt readily available j-hooks of a larger size (e.g., 2×3), to fit and be usable on a smaller-sized rack (e.g., 2×2).

SUMMARY OF THE INVENTION

An example embodiment of the adapter consists of a spacer body, appropriately sized to encompass the excess space existing between the back channel of an oversized j-hook and the back side of the smaller rack upright. A small overhang of material extends laterally from the top of two adjoining sides of the body, located so as to extend over the top of the sides of the j-hook channel and thereby bearing the weight of the body. The side overhang extends beyond the outer edge of the side channel and turns downward to create a tab that engages the outer edge of the side channel and thereby restricts the adapter from movement in the lateral direction. The rear overhang may include a similar tab to engage the rear channel for aesthetic consistency, but such is not required for functional purposes.

When properly inserted into the space between the j-hook channel and the upright, the invention becomes fixed in position, restricted from movement in any direction except upwards (for removal), and maintained in the functional position by its own weight (i.e., gravity). In this position, the invention prevents the oversized j-hook from sliding forward during use, which could allow the j-hook pin to disengage from the holes in the upright and drop the weights. As such, a properly sized spacer of this design achieves the objective of enabling the use of oversized j-hooks on smaller uprights.

Material of manufacture could be plastic, wood, metal, or any variety of suitable materials.

Methods of manufacture may include, but are not limited to: 3D printing, injection molding, machining, or forging.

Thus has been broadly outlined some of the features of this invention, in order that the detailed description of the invention may be better understood. In this respect, it is to be understood that the invention is not limited in its application to the details of construction or to the arrangement of the components set forth in the description or illustrated in the drawings. The invention is capable of alternative embodiments and of being practiced and carried out in various manners. It is to be understood that the phraseology and terminology employed herein are for the purpose of the description and should not be regarded as limiting.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" or "another embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

Figure 1:
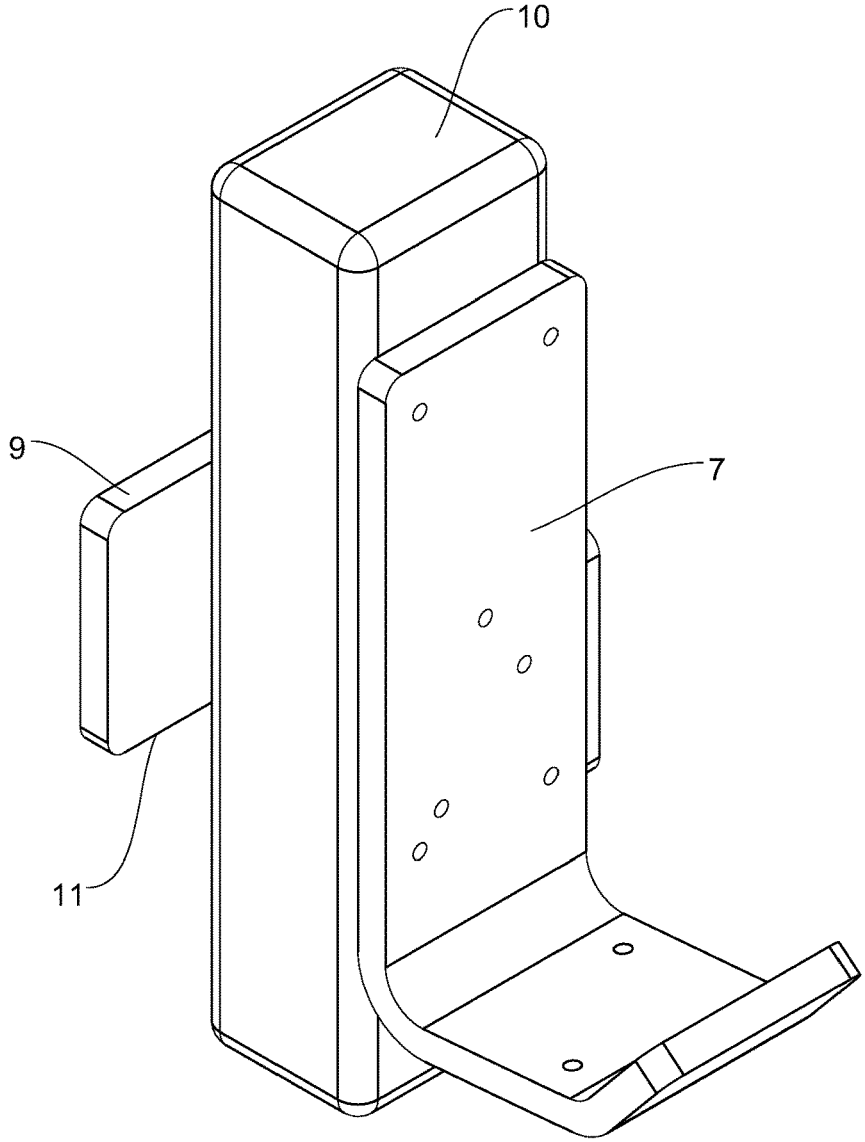
FIG. 1 is a perspective view of an oversized j-hook installed on the upright of the exercise rack, particularly illustrating the gap between the back leg of the j-hook channel and the upright, when an oversized j-hook is utilized.
Figure 2:
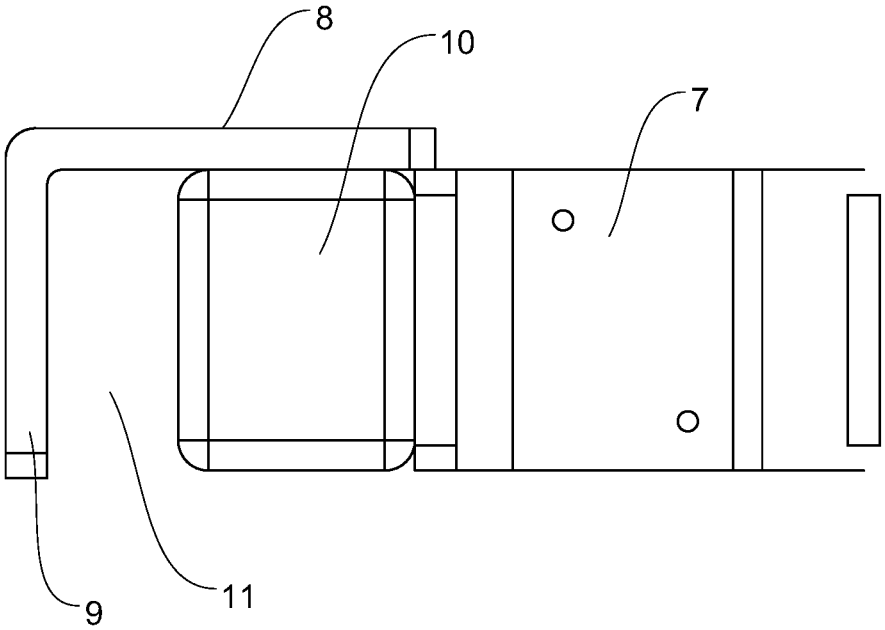
FIG. 2 is a top-down view of the installed oversized j-hook of FIG. 1.
Figure 3:
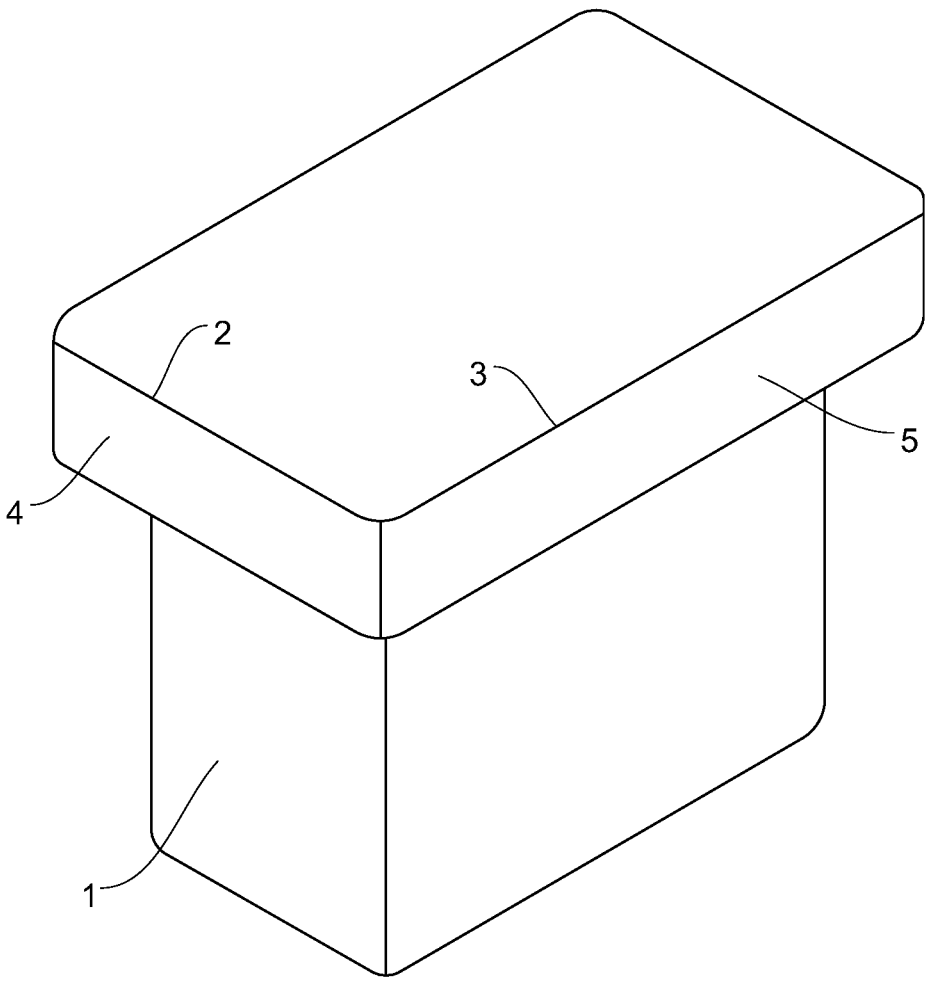
FIG. 3 is a perspective view of the invention from the front-left, according to one embodiment of the present invention.
Figure 4:
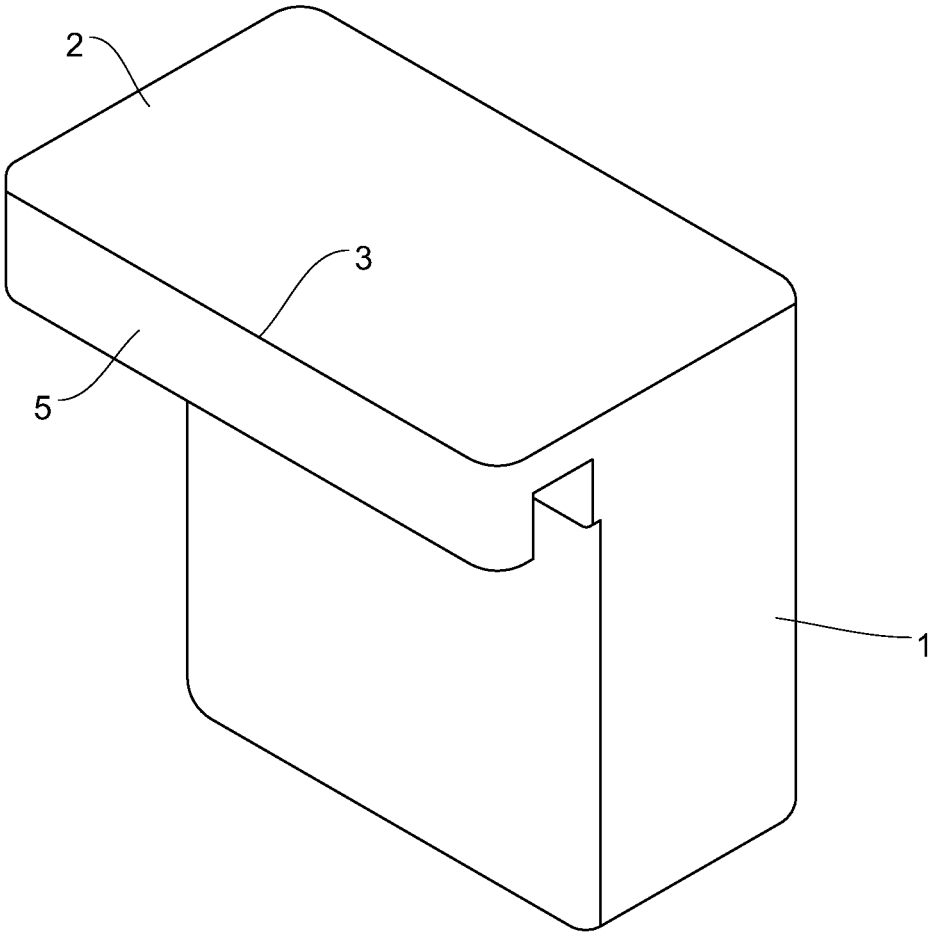
FIG. 4 is a perspective view of the invention from the front-right, according to one embodiment of the present invention.
Figure 5:
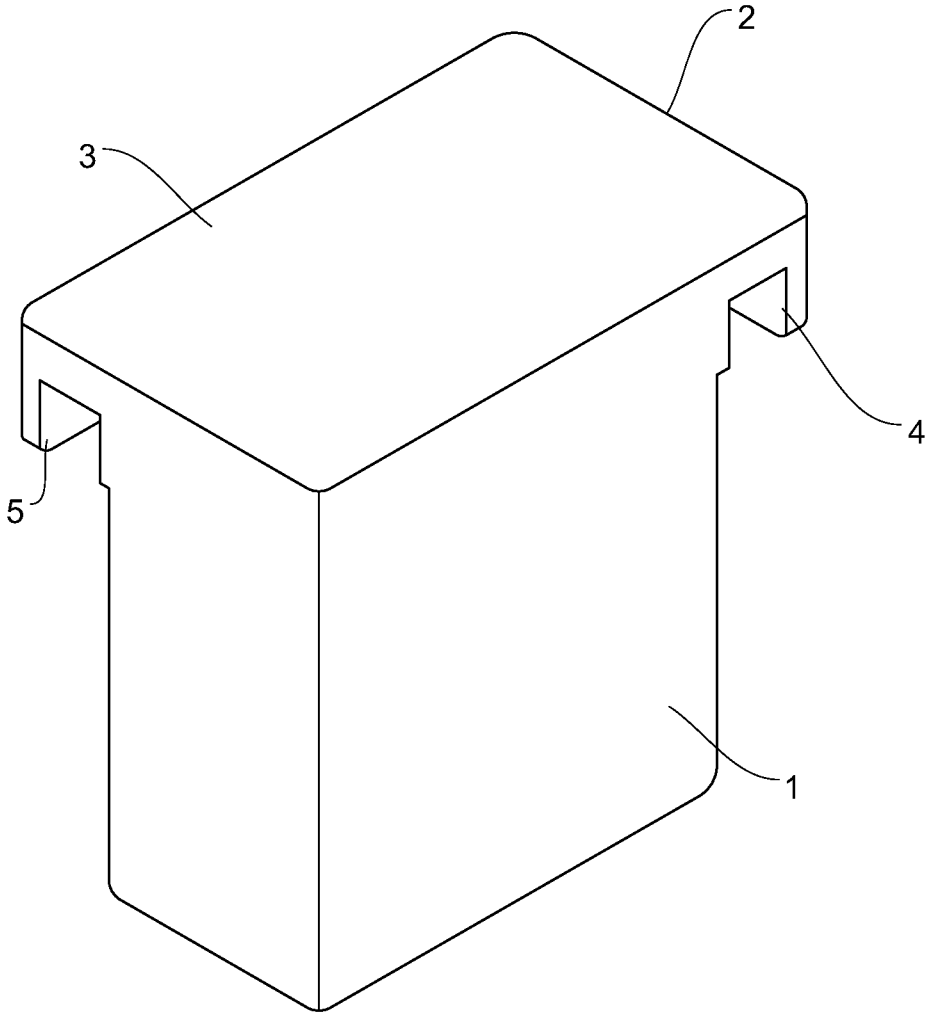
FIG. 5 is a perspective view of the invention from the back-right, according to one embodiment of the present invention.
Figure 6:
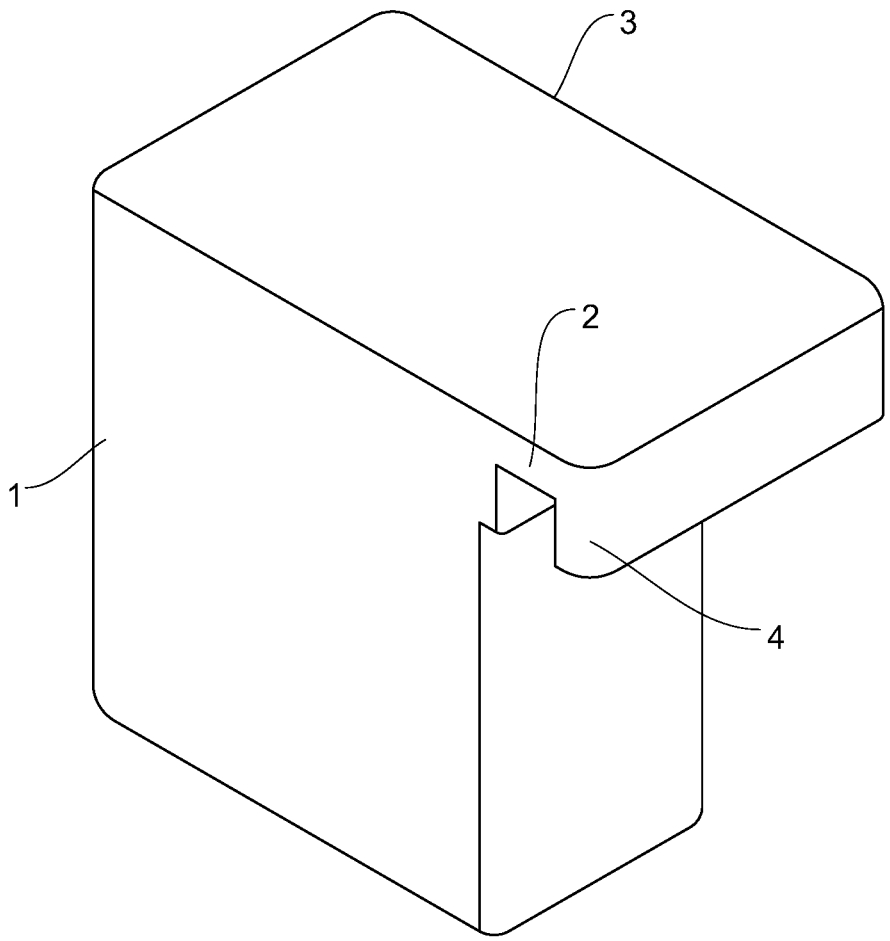
FIG. 6 is a perspective view of the invention from the back-left, according to one embodiment of the present invention.
Figure 7:
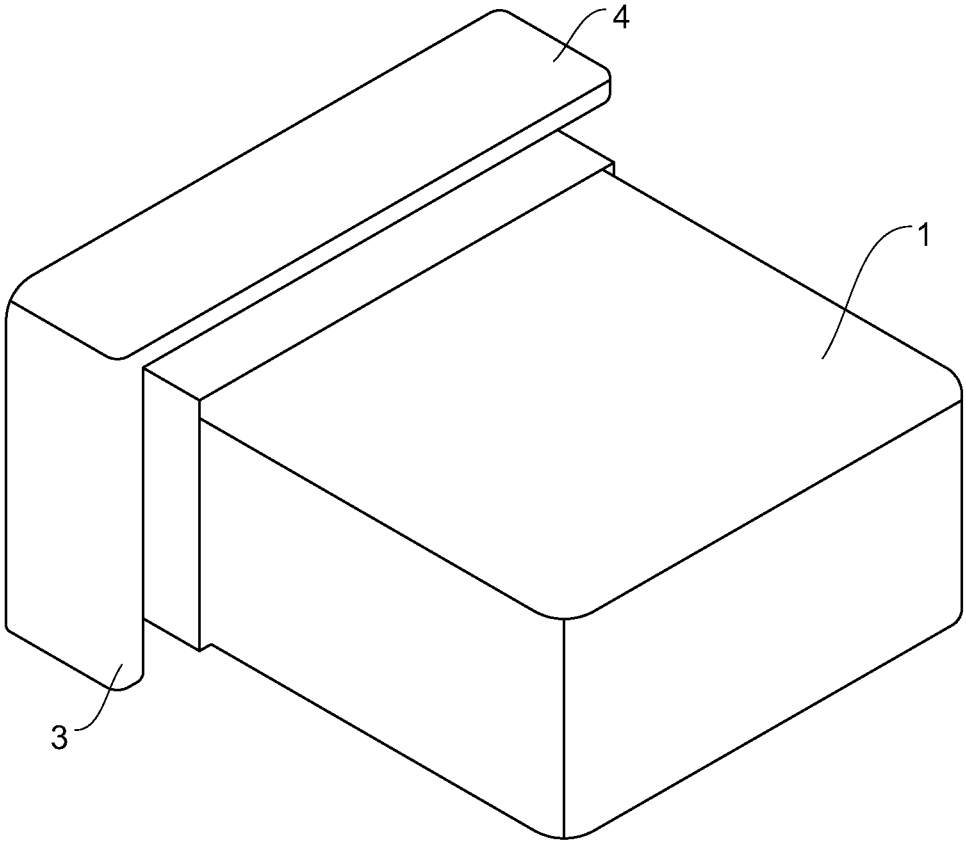
FIG. 7 is a perspective view of the invention from the bottom-left, according to one embodiment of the present invention.
Figure 8:
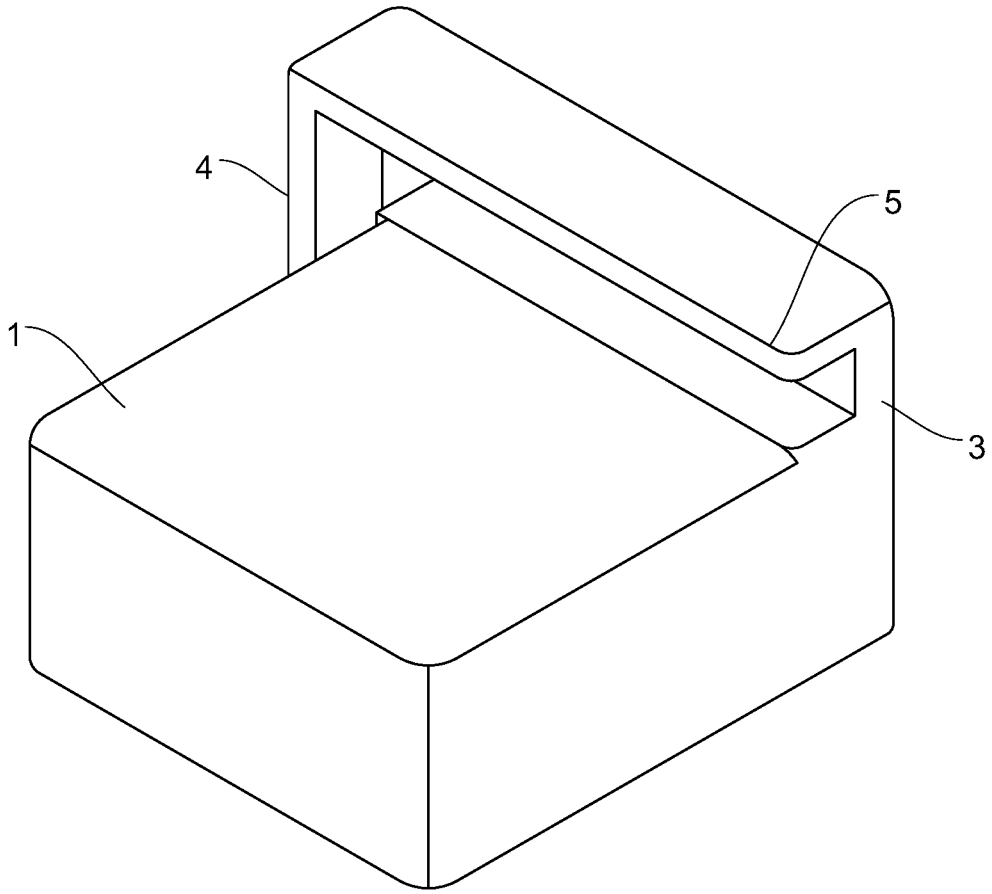
FIG. 8 is a perspective view of the invention from the bottom-right, according to one embodiment of the present invention.
Figure 9:
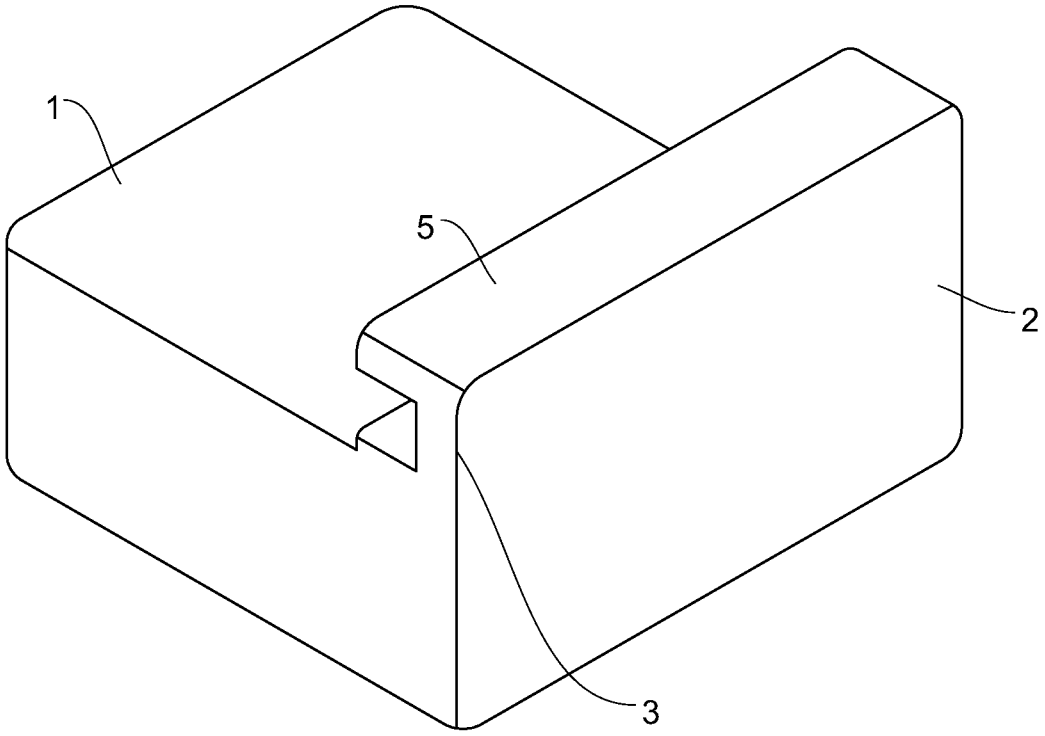
FIG. 9 is a perspective view of the invention from the top-right, according to one embodiment of the present invention.
Figure 10:
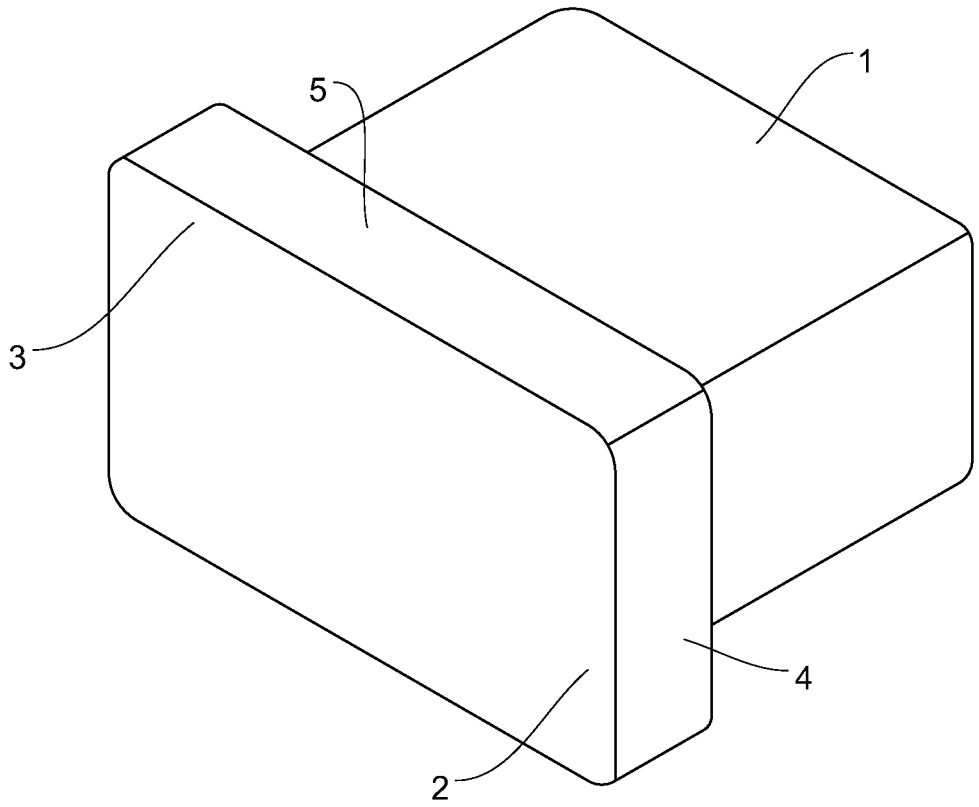
FIG. 10 is a perspective view of the invention from the top-left, according to one embodiment of the present invention.
Figure 11:
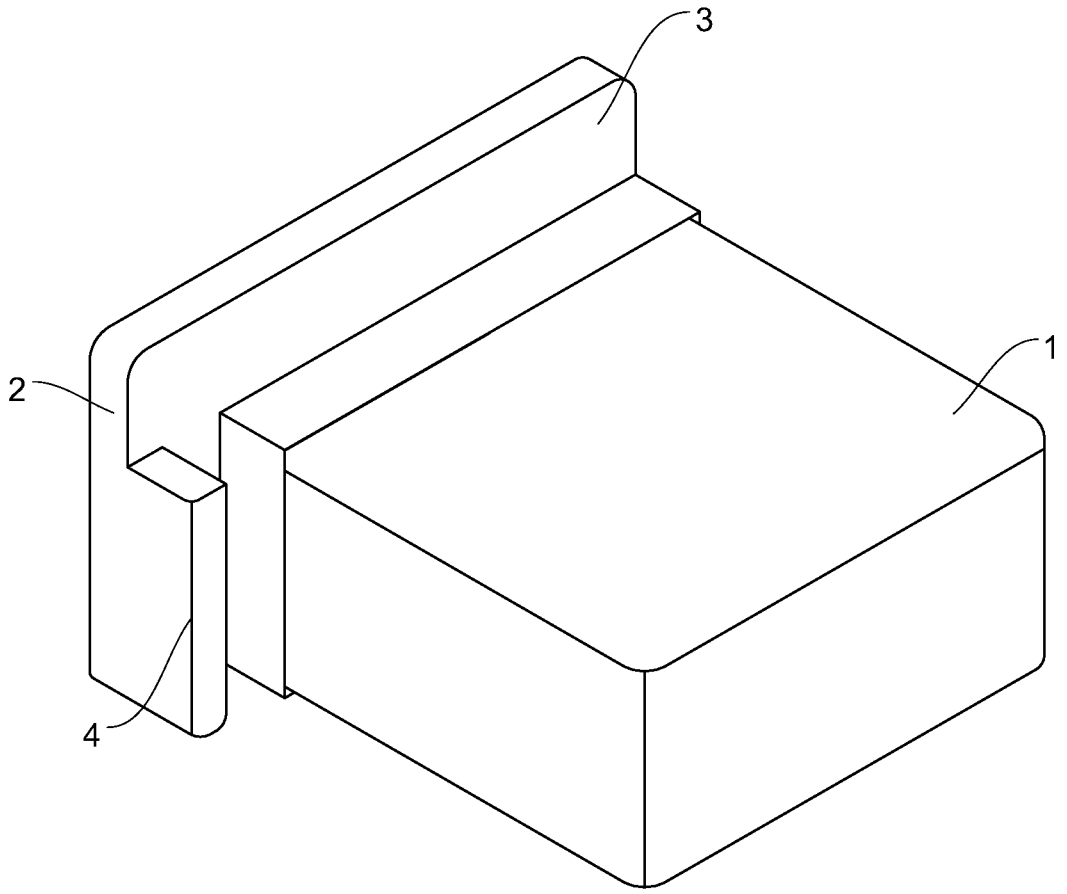
FIG. 11 is a perspective view of an alternative embodiment of the invention from the bottom-left, specifically illustrating the embodiment in which the rear engagement tab is removed.

Referring first to FIGS. 1-2, a typical j-hook 7 is generally illustrated in the installed position against the upright 10 of the exercise rack. FIG. 2 illustrates the side channel 8 and back channel 9 wrapping around the upright 10 to secure the j-hook 7 in place. As these figures illustrate an oversized j-hook 7 installed on an undersized upright 10, as previously described, the resulting gap 11 is hereby generally illustrated. It is this gap 11 that allows the j-hook 7 to slide forward under the weight of the barbell when an oversized j-hook is utilized.

Referring now to FIGS. 3-10, the j-hook adapter is illustrated from multiple perspectives according to one embodiment of the present invention. From the main body 1 of the adapter there extends laterally both a side overhang 2 and end overhang 3, positioned so as to extend over the top of the j-hook side 8 and back 9 channel when installed as in FIGS. 12 and 13. A side engagement tab 4 extends downward from the side overhang 2, which engages with the side channel 8 of the j-hook 7, thereby fixing the body 1 of the adapter in place and restricting it from movement in the lateral direction. An additional rear engagement tab 5 is illustrated in FIGS. 3-10 in the illustrated embodiment of the invention; this rear engagement tab 5 is optional with regard to its effect on the functionality and performance of the present invention.

Figure 12:
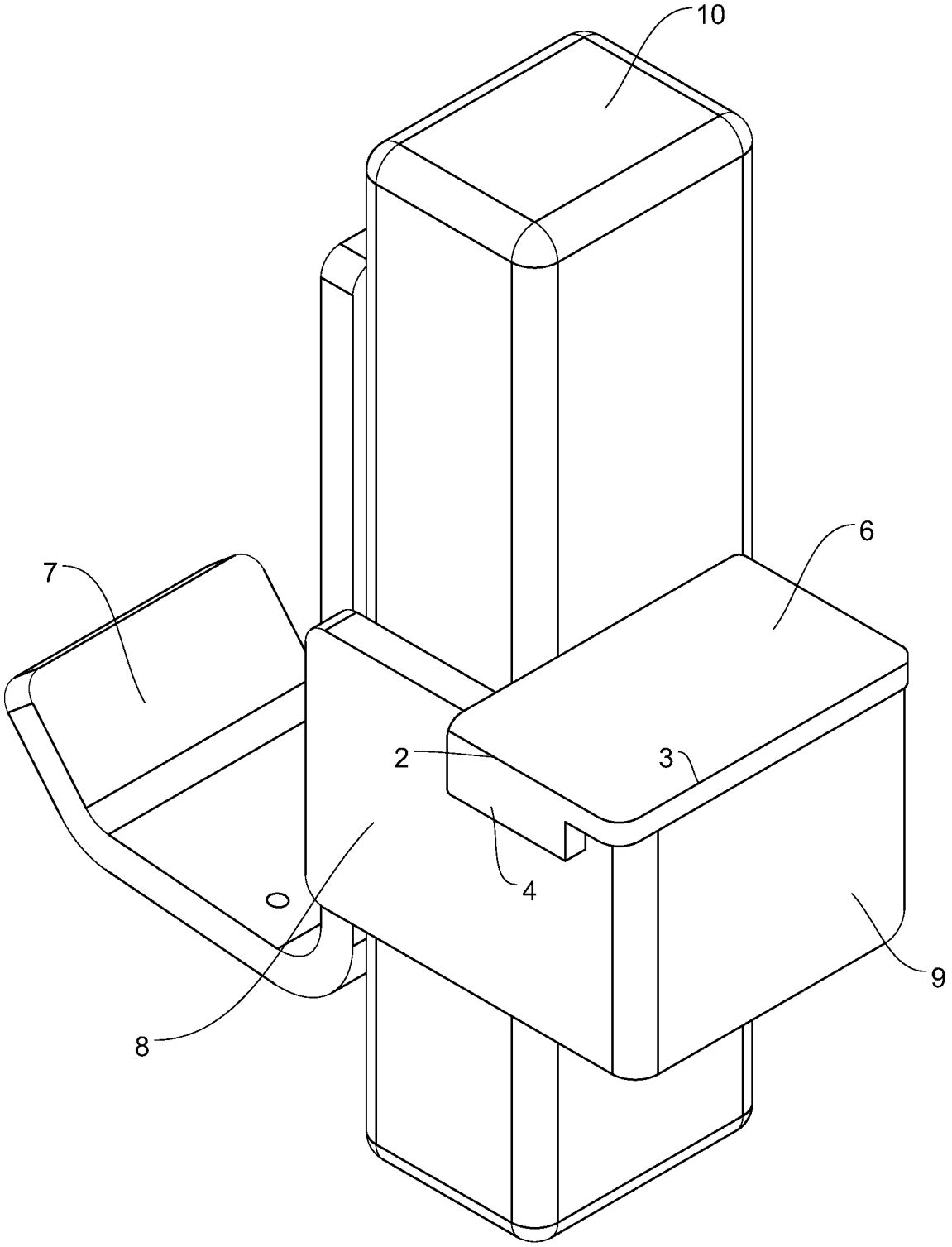
FIG. 12 is a perspective view of the present invention properly installed to adapt an oversized j-hook to the undersized upright, from the back-left.
Figure 13:
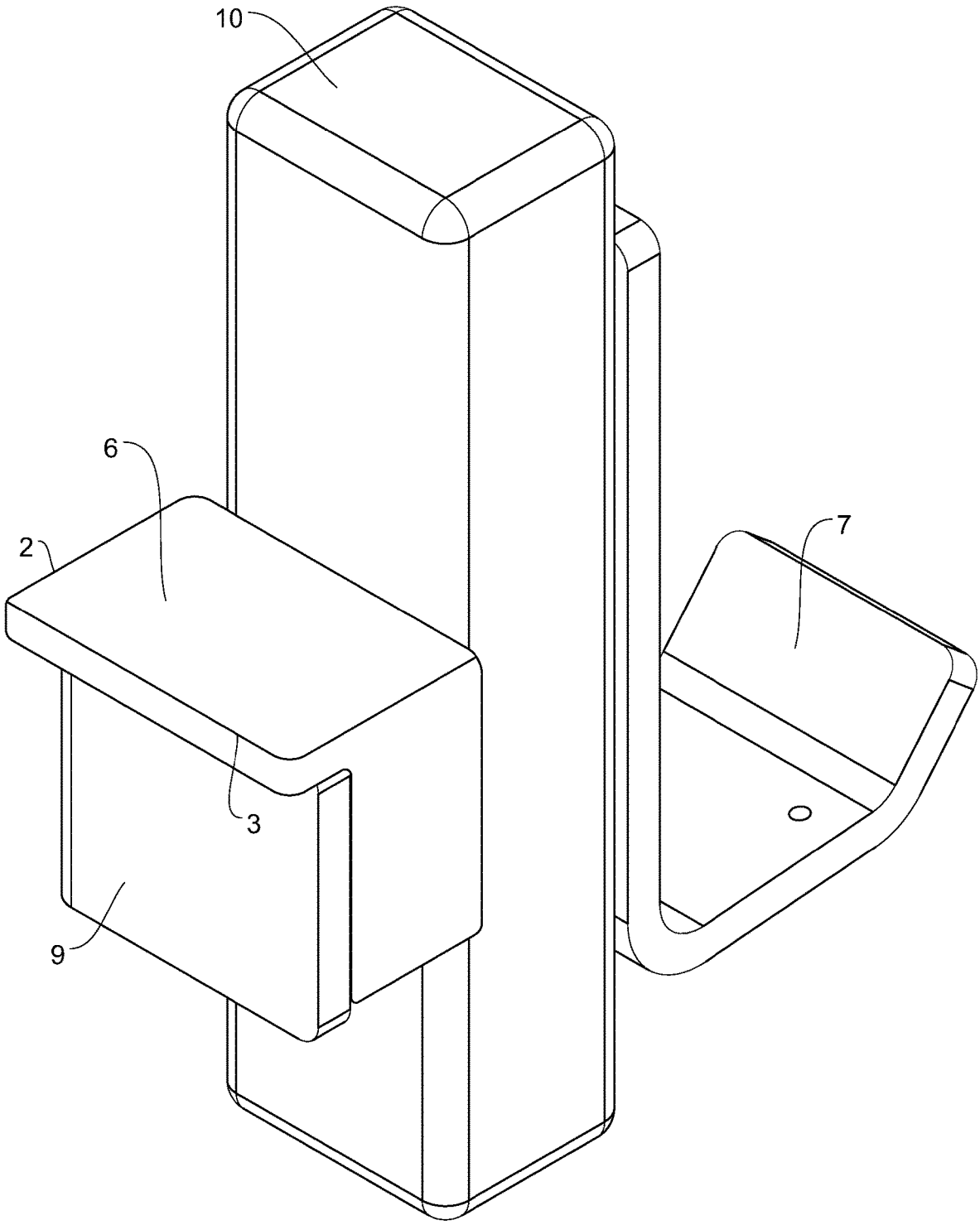
FIG. 13 is a perspective view of the present invention properly installed to adapt an oversized j-hook to the undersized upright, from the back-right.
Figure 14:
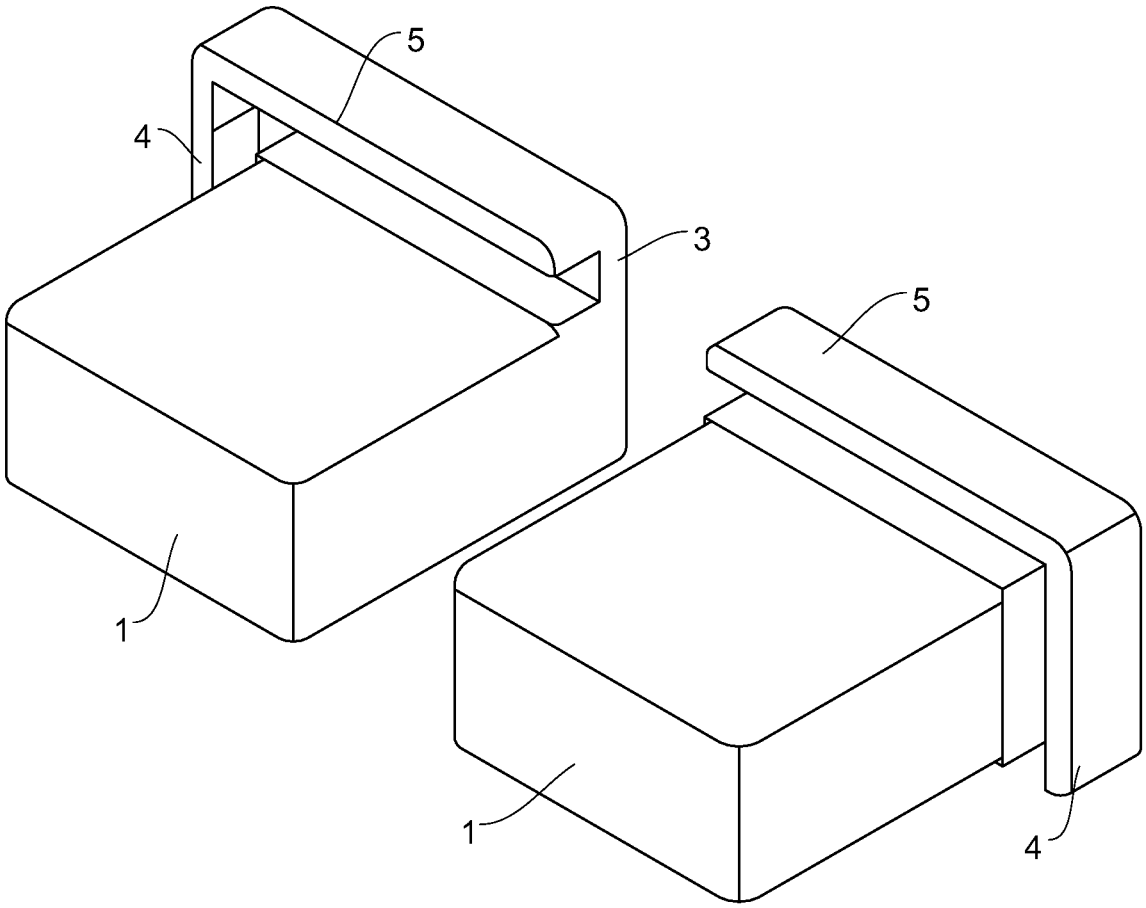
FIG. 14 is a perspective view of a matched and mirrored pair of the invention, for use on both left and right j-hooks, according to one embodiment of the present invention.
Figure 15:
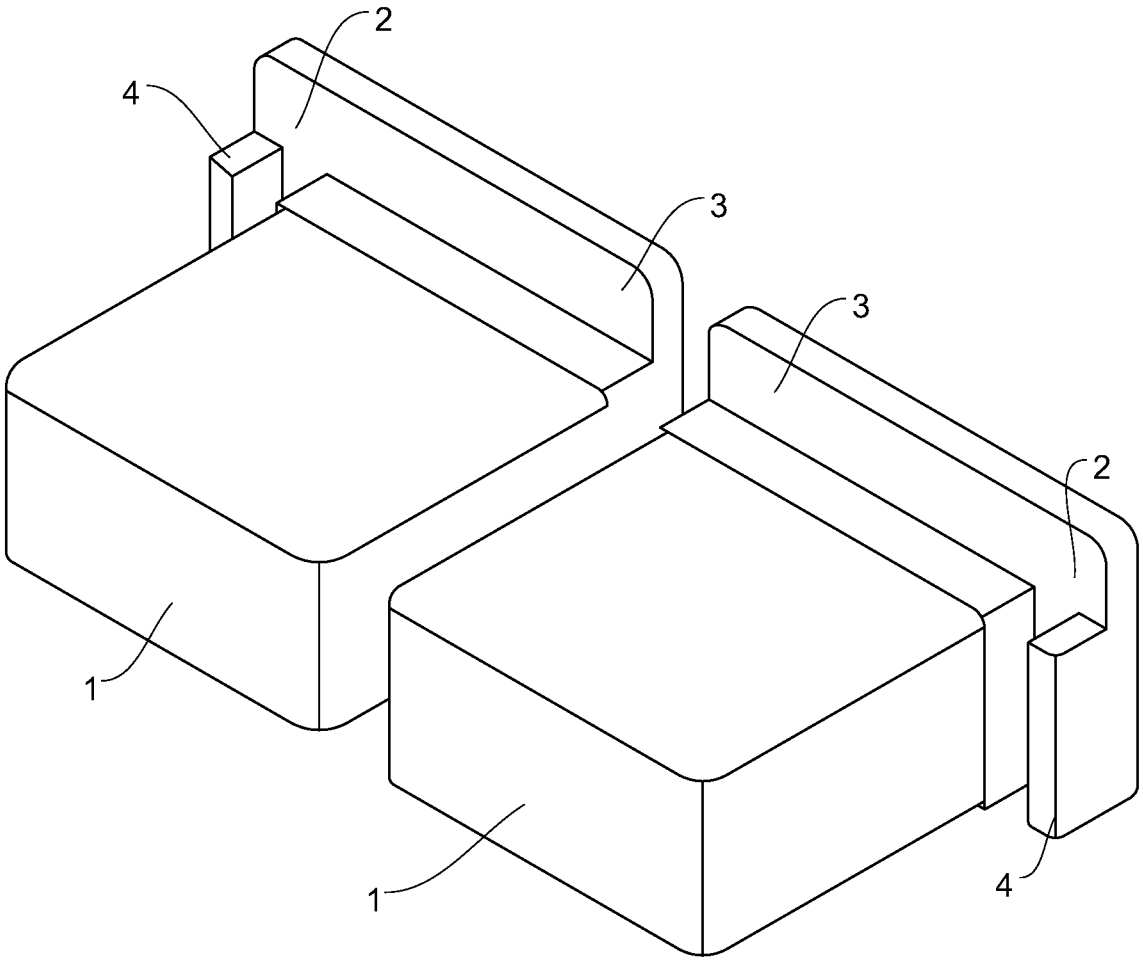
FIG. 15 is a perspective view of a matched and mirrored pair of the invention, for use on both left and right j-hooks, according to an alternative embodiment of the present invention.

FIGS. 12 and 13 illustrate the functional utilization of the present invention. Benefit is achieved by placing the adapter 6 in a vertical orientation above the gap 11, oriented such that overhangs 2 and 3 are vertically positioned above the j-hook side 8 and back 9 channels, respectively. The adapter 6 is then lowered into the gap 11, whereupon overhangs 2 and 3 rest upon the tops of the side and back channels 8 and 9, with the side tab 4 fully engaged with side channel 8 to prevent lateral motion, as illustrated in FIGS. 12 and 13. If installed (not shown in FIGS. 12 and 13), the end tab 5 of the alternative embodiment will fully engage with the back channel 9.

What is claimed is:

1. A self-supporting apparatus having a body, a side overhang, and an end overhang, wherein the side overhang and the end overhang each extend laterally from the body, and a side engagement tab extending downward from the side overhang, wherein the body of which occupies a gap between a bracket of a j-hook and an adjoining squat rack upright.

2. The apparatus of claim 1, having a rear engagement tab extending downward from the end overhang.

3. The apparatus of claim 1, wherein the apparatus is fabricated of plastic, metal, or wood, by a process of 3D printing, injection molding, forging, or machining.

* * * * *